US006641060B2

(12) United States Patent
Brattoli et al.

(10) Patent No.: US 6,641,060 B2
(45) Date of Patent: Nov. 4, 2003

(54) MODULAR KITCHEN DECK SIDE SPRAY

(75) Inventors: Michael A. Brattoli, Elyria, OH (US); Stephen R. Norgrove, Wadsworth, OH (US); Martin Zummersch, Olmsted Falls, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/893,864

(22) Filed: Jun. 28, 2001

(65) Prior Publication Data

US 2003/0001028 A1 Jan. 2, 2003

(51) Int. Cl.[7] ..... B05B 7/02

(52) U.S. Cl. ..... 239/526; 239/525; 239/583; 239/600; 285/321

(58) Field of Search ..... 239/526, 525, 239/582, 583, 587.1, 600; 285/319, 321, 305

(56) References Cited

U.S. PATENT DOCUMENTS

| | | | | | |
|---|---|---|---|---|---|
| 2,200,503 | A | | 5/1940 | Judell et al. | |
| 4,761,839 | A | | 8/1988 | Ganaway | |
| 5,024,419 | A | | 6/1991 | Mulvey | |
| 5,056,562 | A | | 10/1991 | Pawelzik et al. | |
| 5,275,443 | A | * | 1/1994 | Klinger | 285/305 |
| 5,361,431 | A | | 11/1994 | Freier et al. | |
| 5,375,887 | A | | 12/1994 | Johnson | |
| 5,546,978 | A | | 8/1996 | Parker | |
| 5,624,074 | A | | 4/1997 | Parisi | |
| 5,662,276 | A | * | 9/1997 | Ko | 137/218 |
| 5,685,341 | A | | 11/1997 | Chrysler et al. | |
| 5,730,481 | A | * | 3/1998 | Szabo et al. | 285/305 |
| 5,735,555 | A | * | 4/1998 | Answine et al. | 285/319 |
| 5,845,345 | A | | 12/1998 | Ko | |
| 5,951,063 | A | * | 9/1999 | Szabo | 285/303 |
| 6,085,784 | A | | 7/2000 | Bloom et al. | |
| 6,106,027 | A | | 8/2000 | Mulvey et al. | |
| 6,220,297 | B1 | | 4/2001 | Marty et al. | |
| 6,386,596 | B1 | * | 5/2002 | Olson | 285/305 |

* cited by examiner

*Primary Examiner*—Christopher Kim
(74) *Attorney, Agent, or Firm*—Cook, Alex, McFarron, Manzo, Cummings & Mehler, Ltd.

(57) ABSTRACT

A kitchen deck side spray assembly for attachment to a water hose includes a spray body having spray openings. There is a water path in the spray body connecting the spray openings with the hose. A valve member is located in the water path and there is a spring biasing the valve member to a normally closed position. A trigger on the spray body is in operative relationship with the valve member for causing movement thereof to operate the spray. A tube is connected to the water hose and there is a quick connect adapter positioned within the spray body. There are cooperating elements on the tube and the quick connect adapter for locking the tube to the adapter to thereby attach the side spray assembly to the hose. The side spray may be disassembled from the hose, completely from above the sink deck, permitting the exterior of the side spray to be replaced without the necessity of work being done underneath the sink deck.

10 Claims, 1 Drawing Sheet

MODULAR KITCHEN DECK SIDE SPRAY

THE FIELD OF THE INVENTION

The present invention relates to a kitchen deck side spray and more specifically to a modular side spray which can be installed and replaced completely from above the sink deck. This enables the user to replace the exterior decorative components of the side spray without the necessity of going beneath the sink deck and disconnecting the side spray hose from the spout nipple.

The modular side spray consists of a housing, a trigger, a spray body and several internal components which provide for easy connection and removal of the side spray elements from the spray hose. The entire side spray mechanism can be easily attached to the spray hose through the use of a quick connect adapter.

SUMMARY OF THE INVENTION

The present invention relates to a modular kitchen deck side spray and more specifically to such a side spray which may be mounted to the hose completely from above the sink deck.

A primary purpose of the invention is to provide a side spray which may be easily disconnected and replaced, from above the sink deck, with a minimum of interlocking components.

Another purpose is a kitchen deck side spray using a quick connect adapter to easily mount the side spray to the hose connected to the spout nipple.

Another purpose of the invention is to provide a side spray as described in which there are a minimum of components and in which these components may be easily removed from above the sink deck for replacement by like components of a different exterior appearance.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Side sprays are conventionally mounted on a sink deck adjacent to the spout nipple and the faucet volume and temperature control handles, if those are not directly mounted with the spout nipple as in a single lever faucet. The spray is attached to a hose and it is pulled out from the deck and used to direct a spray discharge to the interior of the sink. At times, a homeowner will desire to change the plumbing fixtures which are mounted on the sink deck and this may include not only the spout, but also the control handles. The assignee of the present application, Moen Incorporated, has developed a suite of products, marketed under the trademark M-PACT, which enables the consumer to change the exterior of the products associated with the sink deck, all from above the sink deck and without the necessity of work being performed underneath the deck. The present invention, a side spray, is directed toward the same end and permits the replacement of the side spray from above the sink deck without resort to disconnecting the hose from beneath the deck.

Figure 1:
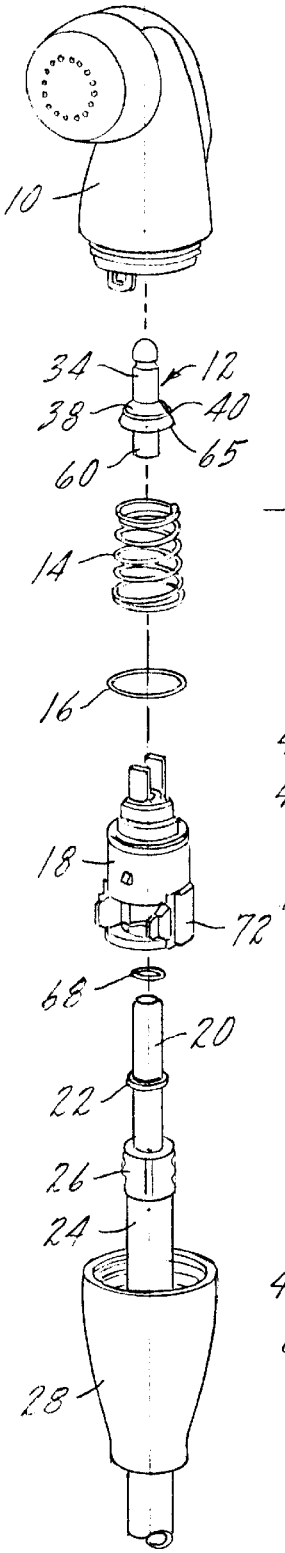
FIG. 1 is an exploded perspective illustrating the components of the kitchen deck side spray.

In FIG. 1, the principal components of the side spray are indicated to include a spray body 10, a valve 12, and a coil spring 14 which biases the valve 12 to a normally closed position. An O-ring 16 extends about the exterior of and seals to a quick connect adapter 18. The adapter will receive one end of a water tube 20 having shoulder 22 which is one of the elements which connects the hose to the side spray. The tube 20 is connected to a hose 24 by means of a crimped connector 26. A housing 28 completes the principal components of the side spray which connect it to the hose 24.

Figure 2:
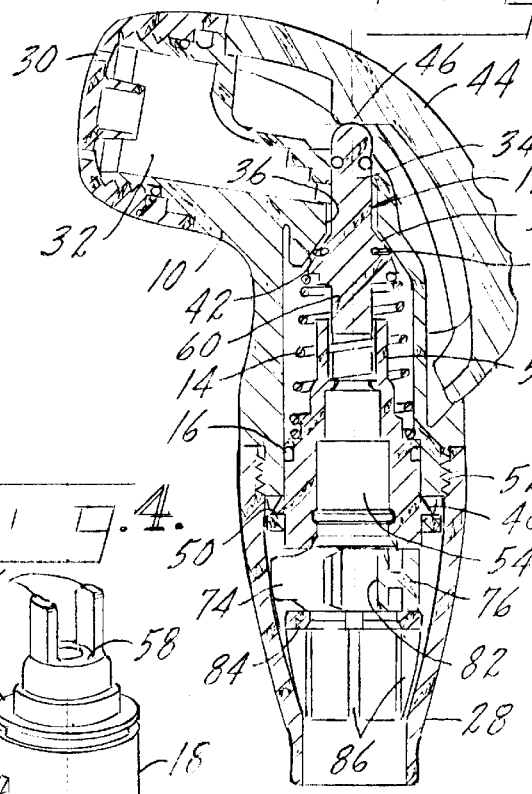
FIG. 2 is an axial section through the side spray prior to connection to a hose.
Figure 4:
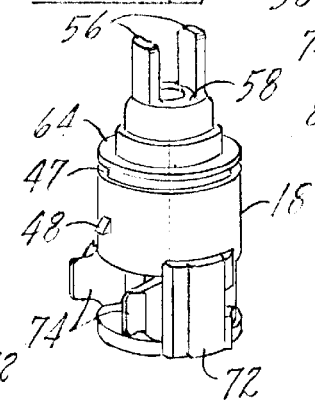
FIG. 4 is a perspective of the quick connect adapter.
Figure 5:
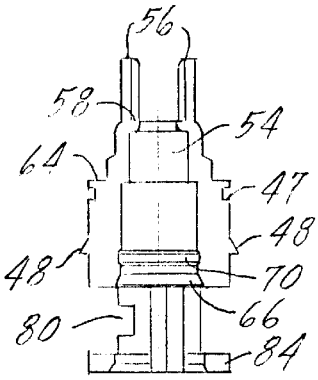
FIG. 5 is an axial section through the quick connect adapter, with the clip removed.

Focusing particularly on FIG. 2, the spray body 10 has a plurality of spray openings 30 which communicate with a chamber 32 which is a part of a water path through the spray body. The valve 12 has a head 34 which extends through an opening 36 in the spray body, with the opening 36 being closed by a tapered shoulder 38 on the valve, carrying an O-ring 40, with the O-ring bearing against a tapered wall 42 of the passage 36. The passage 36 and the chamber 32 form a part of the water path to the spray openings, which path is normally closed by the valve 12 as it is biased to the closed position of FIG. 2 by the spring 14. The valve 12 is operated by a trigger 44 mounted on the side spray body and having a projection 46 which is effective to move the valve 12 away from the closed position of FIG. 2 when the trigger 44 is pressed inwardly on the spray body. The above-described construction is conventional in side sprays.

The quick connect adapter 18 has an annular groove 47 to receive the O-ring 16 which seals between the adapter and the spray body 10. Directly below the groove 47 there are outwardly-extending projections 48 which will rest upon an internal shoulder 50 in the housing 28 to support the quick connect adapter within the housing. The housing 28 is secured to the spray body 10 by means of a threaded connection 52 illustrated in FIGS. 2 and 3. The quick connect adapter 18 has an internal chamber 54 and a pair of upstanding arcuate fingers 56. The fingers 56 terminate in a shoulder 58 which together with the fingers forms a socket to support the valve shaft 60, as particularly shown in FIGS. 2 and 3. The spring 14 will bottom on a flange 64 on the exterior of the connector 18 and is in contact with the underside of a flange 65 on the valve 12.

Figure 3:
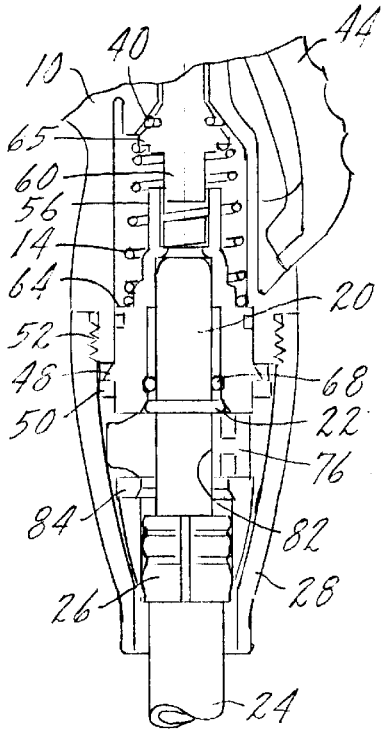
FIG. 3 is a partial axial section illustrating the side spray connected to the spray hose.

The tube 20 carries the described shoulder 22 which in the connected position of FIG. 3 is held against a tapered shoulder 66 formed at the base of the connector chamber 54. An O-ring 68 is located within the chamber 54 of the connector 18 in a groove 70, and this O-ring will extend about the tube 20 when the tube is fully inserted into the connector.

The connector includes a spring clip 72 having a pair of arms 74 connected together by a body portion 76 illustrated in FIGS. 2 and 3. The spring clip is positioned within a chamber 80 of the connector 18 and is movable back and forth within that chamber to effect an interlock with the tube 20 and its shoulder 22. There is a further portion 82 of the clip 72 which bears directly against the tube 20 in the fully connected position of FIG. 3. The bottom flange 84 of the connector 18 is supported on a series of spaced ribs 86 formed on the inside of housing 28.

To disassemble the side spray, the first step is to unthread the spray body from the housing 28. The adapter 18 may then be pulled out to provide access to the clip 72 which may be pushed outward from the chamber 80 to release the tube 20 and its shoulder 22 from the interior of the adapter. The housing 28 may then be removed from the hose. To replace the housing and the spray body with new components of a similar mechanical configuration and function, the tube 20 may be passed through the housing and re-inserted into the adapter, after the clip 72 has been pushed outward from the chamber 80 to permit such insertion. The clip is then pushed in, locking the tube within the adapter 18, as the shoulder 22 will bear against the tapered surface 66 and the clip will hold it in this position. The spray body and the associated trigger mechanism may then be threadedly attached to the housing 28 and the side spray is ready for use. All of the above steps are done from above the sink deck without resort to the area beneath the deck. The hose and its associated tube, which are held together by the connector 26, are easily removed from the connector 18 by manipulation of the clip 72.

Whereas the preferred form of the invention has been shown and described herein, it should be realized that there may be many modifications, substitutions and alterations thereto.

The embodiments of the invention in which an exclusive property or privilege is claimed are as follows:

1. A kitchen deck side spray assembly for attachment to a water hose includes a spray body, spray openings in said spray body, a water path being defined in said spray body and adapted for fluidly connecting said spray openings with the hose, a valve member in said water path, a spring biasing said valve member to a normally closed position, a trigger on said body and in operative relationship with said valve member for causing movement thereof, a water tube, means for connecting said tube to the water hose, a quick connect adapter positioned within said spray body, cooperating means on said tube and quick connect adapter for removably locking said tube to said adapter to thereby attach said side spray assembly to the hose and said adapter having a socket to support said valve member.

2. The side spray of claim 1 wherein said cooperating means includes an interlocking element on said tube, and a movable clip located in said quick connect adapter.

3. The side spray of claim 2 wherein the interlocking element on said tube includes a shoulder formed thereon.

4. The side spray of claim 2 wherein said clip is positioned within and movable within a chamber in said quick connect adapter.

5. The side spray of claim 4 wherein said clip has a pair of flexible arms permitting said clip to move inwardly and outwardly of said chamber.

6. The side spray of claim 5 wherein said arms are joined by an arcuate portion of said clip, with said clip having an interior locking portion formed and positioned to interlock with a shoulder on the tube.

7. The side spray of claim 6 wherein said quick connect adapter has an annular recess, spaced from its chamber, with said shoulder being positioned in said recess to hold said tube within said quick connect adapter.

8. The side spray of claim 1 further including a housing extending about said tube and having a support means to mount said quick connect adapter within said tube.

9. The side spray of claim 8 wherein said support means includes a plurality of ribs positioned on an interior surface of said housing.

10. The side spray of claim 1 wherein said water path extends through said adapter.

* * * * *